United States Patent [19]

Lisiecki

[11] 4,341,340

[45] Jul. 27, 1982

[54] CONTAINER WITH INFOLDED BOTTOM CLOSURE

[75] Inventor: Robert E. Lisiecki, Orchard Lake, Mich.

[73] Assignee: Ex-Cell-O Corporation, Troy, Mich.

[21] Appl. No.: 187,648

[22] Filed: Sep. 16, 1980

[51] Int. Cl.[3] ..... B65D 5/08

[52] U.S. Cl. ..... 229/37 R; 229/17 R

[58] Field of Search ..... 229/37 R, 38, DIG. 9, 229/17 R

[56] References Cited

U.S. PATENT DOCUMENTS

| | | | |
|---|---|---|---|
| 2,432,122 | 12/1947 | Pardee | 229/37 R |
| 2,673,024 | 3/1954 | Kuss | 229/37 R |
| 2,962,202 | 11/1960 | Hansen | 229/37 R |
| 3,202,339 | 8/1965 | Franklin | 229/DIG. 9 |
| 3,227,353 | 1/1966 | Bump | 229/17 G |
| 3,291,369 | 12/1966 | Crawford | 229/17 G |
| 3,365,115 | 1/1968 | Pike | 229/38 |
| 3,406,892 | 10/1968 | Egleston | 229/37 R |

FOREIGN PATENT DOCUMENTS

| | | | |
|---|---|---|---|
| 630622 | 10/1949 | United Kingdom | 229/17 G |

*Primary Examiner*—Herbert F. Ross

*Attorney, Agent, or Firm*—John P. Moran

[57] ABSTRACT

This disclosure illustrates and describes a bottom closure structure for a liquid carrying, thermoplastic coated paperboard carton or container wherein the shapes of the four main bottom panels of the blank from which the carton is formed are such that they provide bottom panel side score lines which are sufficient in length to support the panels during the folding and tucking operation changing the flat blank into a finished carton bottom closure. In one embodiment of the invention, complete interdigital nesting or overlapping of adjacent blanks is provided for. As such, the cutting operation on a paperboard roll may be accomplished with an uninterrupted cut, without any resultant paperboard scrap being produced therebetween.

6 Claims, 7 Drawing Figures

CONTAINER WITH INFOLDED BOTTOM CLOSURE

TECHNICAL FIELD

This invention relates generally to liquid carrying paperboard cartons or containers and, more particularly, to a novel fold-in bottom closure for such containers.

BACKGROUND ART

It is well known that paperboard used for milk and juice containers can be economically coated with heat and pressure sensitive thermoplastic substances. Such substances must be inert to the substances to be packaged, strong and durable, inexpensive, and easy to apply in sheet form onto the paperboard. One example of a suitable thermoplastic substance, useful for packaging dairy products, is polyethylene.

The paperboard stock for forming the containers is initially supplied in the form of rolls. As the stock is produced it is coated on both sides with layers of polyethylene of predetermined thicknesses. Blanks are then cut from the thus treated paperboard roll, and scored so as to be adaptable to being folded into a tubular shape with readily foldable and sealable leakproof top and bottom closures. Generally, it has been desirable for the finished bottom end closure to contain a multi-layer reinforced fold at each bottom corner, with a minimal length of raw edge exposed to the interior of the container and, hence, to the contents thereof.

A very satisfactory and widely used container and infolded bottom closure is that shown and described in Egleston et al. U.S. Pat. No. 3,120,335.

In view of the fact that a considerable volume of thermoplastic coated paperboard is used for the packaging of milk and juices on today's market throughout the world, it is desirable to save as much paperboard as possible while maintaining the current high standards for efficiently manufacturing a high quality, leak-proof, sanitary container. A paperboard container arrangement which results in substantial paperboard savings is shown and described in patent application, Ser. No. 132,014, filed on Mar. 20, 1980, in the name of John P. Moran and assigned to the assignee of the present invention.

DISCLOSURE OF THE INVENTION

An object of this invention is to provide an improved paperboard container blank wherein the four panels thereof which serve to make up the bottom end closure are shaped so as to accommodate internesting of adjacent rows of blanks, resulting in substantial thermoplastic coated paperboard savings while providing adequate scored edge support for efficient folding and tucking operations.

Another object of the invention is to provide an improved paperboard-saving, bottom end closure for a liquid carrying, heat sealable container, wherein the bottom end closure is adaptable to conventional tucking and tacking apparatus on current forming, filling and sealing machines with minimal modification of the latter.

A further object of the invention is to provide paperboard container blanks internested in such a manner that they may be cut apart with an uninterrupted cut, thereby producing negligible coated paperboard scrap.

Still another object of the invention is to provide such an improved bottom end closure which is adaptable, after being folded, to being sealed by conventional gas heat, electrical, or ultrasonic methods.

These and other objects and advantages of the invention will be apparent when reference is made to the following description and accompanying drawings.

BEST MODE OF CARRYING OUT THE INVENTION

Figure 1:
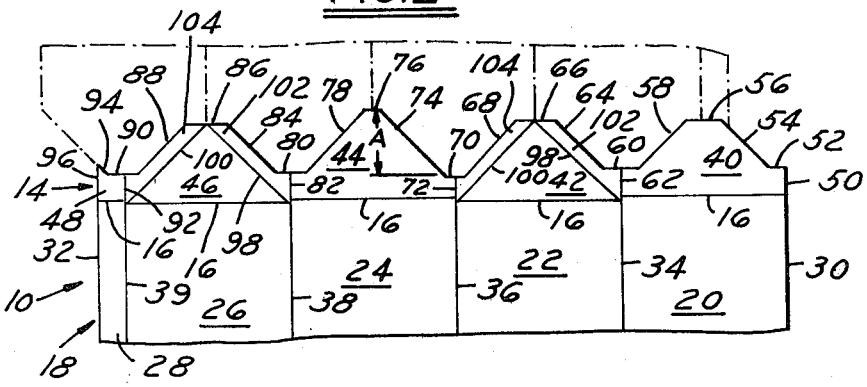
FIG. 1 is a layout view of a portion of a blank from which the bottom closure of the invention is formed, showing the outside surface thereof, along with illustrating the internested position of an adjacent blank in phantom prior to being cut from a paperboard roll.
Figure 2:
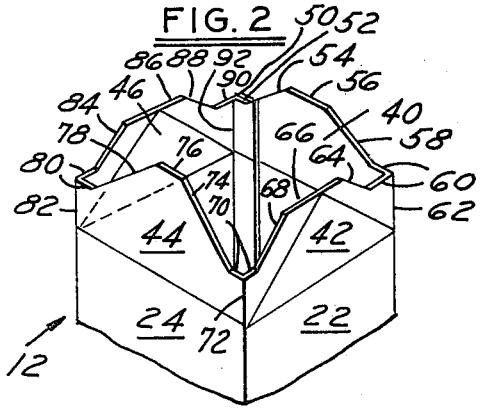
FIGS. 2 and 3 are fragmentary perspective views illustrating sequentially various steps in forming the bottom closure.

Referring now to the drawings in greater detail, FIG. 1 illustrates a fragmentary blank 10 suitable for being formed into a tubular body 12, as shown in FIGS. 2–5. One end of the body 12 is provided with a suitable top end closure (not shown), such as the familiar gable top configuration of Egleston et al. U.S. Pat. No. 3,270,940, incorporated herein by reference.

Figure 4:
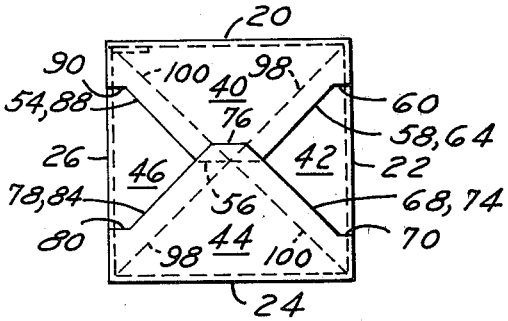
FIG. 4 is an outside view of the container bottom.

The flat bottom end closure 14 of FIG. 4 is shaped from the blank 10 of FIG. 1 which is separated into two groups of panels by a staggered score line 16. The purpose of the score line 16 being staggered in the form shown is to accommodate the thickness of the sheet material as it is bent along the score lines when the closure is erected and thus prevent crowding of the material at the various corner junctions of the score lines. This not only enhances the strength and appearance of the finished container but facilitates its erection and closure by automatic machinery. The material above the score line 16 in FIG. 1 is the bottom closure group 14 while the material shown below the line 16 is the body group 18. The latter comprises four side panels 20, 22, 24 and 26 and a side seam panel or flap 28. The body group is defined on the sides by edges 30 and 32, with the panels being separated by score lines 34, 36, 38 and 39.

Figure 7:
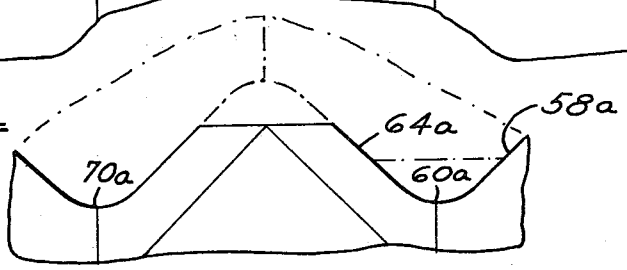
FIG. 7 is a layout view of a portion of still another alternate blank embodiment of the invention.

The bottom closure group 14 comprises closure panels 40, 42, 44 and 46 adjacent the body panels 20, 22, 24 and 26, respectively, and a panel extension 48 of the side seam panel 28. The closure panels 40, 42 and 46 are essentially the same in shape and height, while the panel 44 is similar in shape but greater in height. More specifically, the panel 40 is bounded by the score line 16, an edge 50 extension of the edge 30, an edge 52 extending laterally from the end of the edge 50, an edge 54 extending outwardly at a 45° angle from the end of the edge 52, a lateral edge 56 forming the outer edge of the panel, an edge 58 extending inwardly at a 45° angle from the edge 56, an edge 60 extending laterally from the inner end of the edge 58, and a vertical score line 62 extension of the score line 34. The distance between the score line 16 and the outer edge 56 is one half the width of a body panel. It should be apparent that a radius could be used in lieu of the obtuse angle between each sloped edge and the adjacent inner lateral edge, e.g., at the juncture between the edges 58 and 60 and between the edges 64 and 60, as illustrated in FIG. 7.

The panel 42 is bounded in the counterclockwise direction, as shown in FIG. 1, by the score lines 16 and 62, the lateral edge 60, a 45° sloped edge 64, an outer edge 66, a 45° sloped edge 68, a lateral edge 70, and a vertical score line 72 extension of the score line 36. The score line 72 is shorter than the score line 62, for a purpose to be described.

The higher panel 44 is bounded by the score lines 16 and 72, the lateral edge 70, a 45° sloped edge 74, an outer edge 76, a 45° sloped edge 78, a lateral edge 80, and a vertical score line 82 extension of the score line 38.

The panel 46 is bounded by the score lines 16 and 82, the lateral edge 80, a 45° sloped edge 88, a lateral edge 90, and a vertical score line 92 extension of the score line 39.

The panel extension 48 is bounded by the score lines 16 and 92, the lateral edge 90, a short 45° sloped edge 94, and a vertical edge 96 extension of the edge 32.

As indicated above, the bottom end closure panels 40, 42, 44, 46 and 48 are formed so as to have 90° angles between adjacent sloped edges. As such, cutting a roll of paperboard with a single knife blade to form the sloped edges 54, 58, 64, 68, 74, 78, 84, 88 and 94 and the lateral edges 52, 56, 60, 66, 70, 76, 80, 86 and 90 will also serve to form the sloped edges and lateral edges of the bottom end closure panels of the adjacent blank, shown in phantom in FIG. 1, resulting in no scrap being produced therebetween.

It should also be noted that, inasmuch as the blanks 10 are cut from a wide roll of paperboard, an adjacent blank 10' (FIG. 1) having its bottom end closure panels 40', 42', 44', 46' and 48' internested with the adjacent closure panels 48, 46, 44, 42 and 40, respectively, saves a width of paper equal to the vertical height of the sloped edge 74 of the largest closure panel 44, represented in FIG. 1 as "A". For those applications wherein the roll of paperboard is wide enough for four blanks abreast, it is apparent that the width of paperboard saved would be twice the height "A".

The two oppositely disposed end panels 42 and 46, which are joined to opposite sides of the largest end panel 44, each have formed thereon a pair of converging or diagonal score lines 98 and 100, forming oppositely disposed outer panels 102 and 104 with the respective adjacent sloped edges. One diagonal score line 98 extends from the juncture of the score lines 16, 34 and 62 to the edge 66 of the panel 42, while the other diagonal score line 98 extends from the juncture of the score lines 16, 38 and 82 to the edge 86 of the panel 46, respectively. One diagonal score line 100 extends from the juncture of the score lines 16, 36 and 72 to the edge 66 of the panel 42, while the other diagonal score line 100 extends from the juncture of the score lines 16, 39 and 92 to the edge 86 of the panel 46, respectively. The diagonal score lines 98 and 100 converge at the outer edges 66 and 86 of the panels 42 and 46 respectively.

To construct the container bottom closure as shown in FIG. 4, a flat side seamed blank is first formed by folding the blank 10 upon itself and sealing the side seam flap 28 and its extension 48 to the inside faces of panels 20 and 40, respectively, using any of the well-known plastic sealing methods such as heat, sound or light. The folded blank is next formed into the tubular body 12 (FIG. 2) on a mandrel (not shown), with the bottom closure panels extending outwardly from the face of the mandrel. Following this, the container bottom is infolded (FIG. 3) and sealed (FIG. 4).

Figure 3:
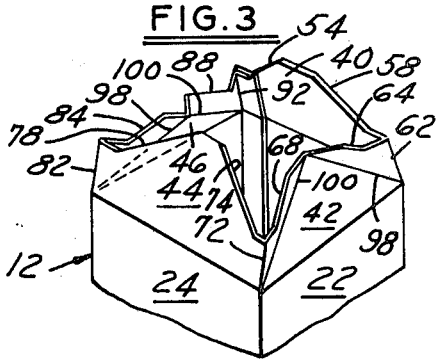

As indicated in FIG. 3, the inner triangular portions of the panels 42 and 46 are urged toward each other, with the outer portions 102 and 104 thereof caused to fold outwardly about the score lines 98 and 100 and toward the inner triangular portions, supported during the folding operation by the side score lines 62, 72, 82 and 92. As may be noted from FIGS. 2 and 3, increased height of each of the corner score lines 62, 72, 82 and 92 is afforded by the lateral edge cuts 60, 70, 80 and 90 in contrast to having the sloped edges extend to their respective adjacent corner score lines, e.g., extending edges 58 and 64 so as to intersect at the score line 62, resulting in a much shorter score line 62.

By virtue of such increased height, sufficient support is provided for the efficient initial folding of the oppositely disposed panels 42 and 46 inwardly, toward each other, causing the edge panels 102 and 104 to fold outwardly about the respective diagonal score lines 98 and 100, as indicated in FIG. 3, and as would be automatically accomplished by conventional folding and tucking arrangements, such as those shown and described in U.S. Pat. No. 3,187,646, issued in the name of C. Z. Monroe et al, and in U.S. Pat. No. 3,398,659, issued in the name of H. G. Egleston, both assigned to the assignee of the present invention.

The lateral edge cuts resulting in edges 52, 60, 70, 80 and 90 should also facilitate cutting by the manufacturer or converter of the carton blanks from roll stock in that corner cuts of greater than 45° are provided. Such cuts could, of course, consist of radii in lieu of corners, as indicated above.

Upon completion of the folding of the panel 40 onto the panels 42 and 46 and the longer panel 44 so as to overlap the edge of the panel 40, the edge panels 102 and 104 are confined between the inside panels 42/46 and the outside panels 40/44, as shown in FIG. 4, with the longer panel 44 overlapping the end portion of the opposite outside panel 40. The resultant flat end configuration is sealed by any suitable method, such as by gas heat or ultrasonically, in a substantially "X" shaped pattern, i.e., along the four diagonal, triple layered segments extending from each corner to the center of the bottom closure.

Provision may be made for obtaining an exceptionally tight seal of the bottom closure when finally completed. This is accomplished by proportioning the outer edges 66 and 86 of the panels 102 and 104 such that they enter into positive abutting engagement with themselves (FIG. 3) prior to completion of the bottom closure. More specifically, the panels 42 and 46 may be so proportioned that the combined length thereof is slightly greater than the width of each side panel measured along the score line 16. Thus, the paperboard is "crowded" together in the closing operation, thereby greatly enhancing the tightness of the bottom seal.

Figure 5:
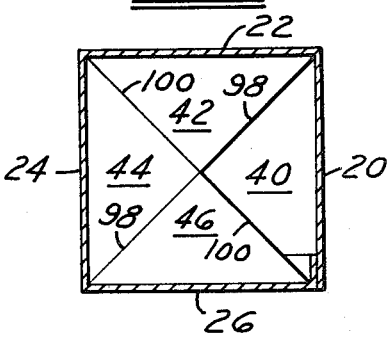
FIG. 5 is a cross sectional view of the container showing an inside view of the container bottom.

In FIG. 5, it may be noted that, on the inside of the container, the apices of the triangles formed by the score lines 98 and 100 of the panels 42 and 46 meet at the center of the container, while the edge of the panel 40 lies directly underneath. Hence, substantially no raw edges are exposed on the inside of the bottom end closures.

Figure 6:
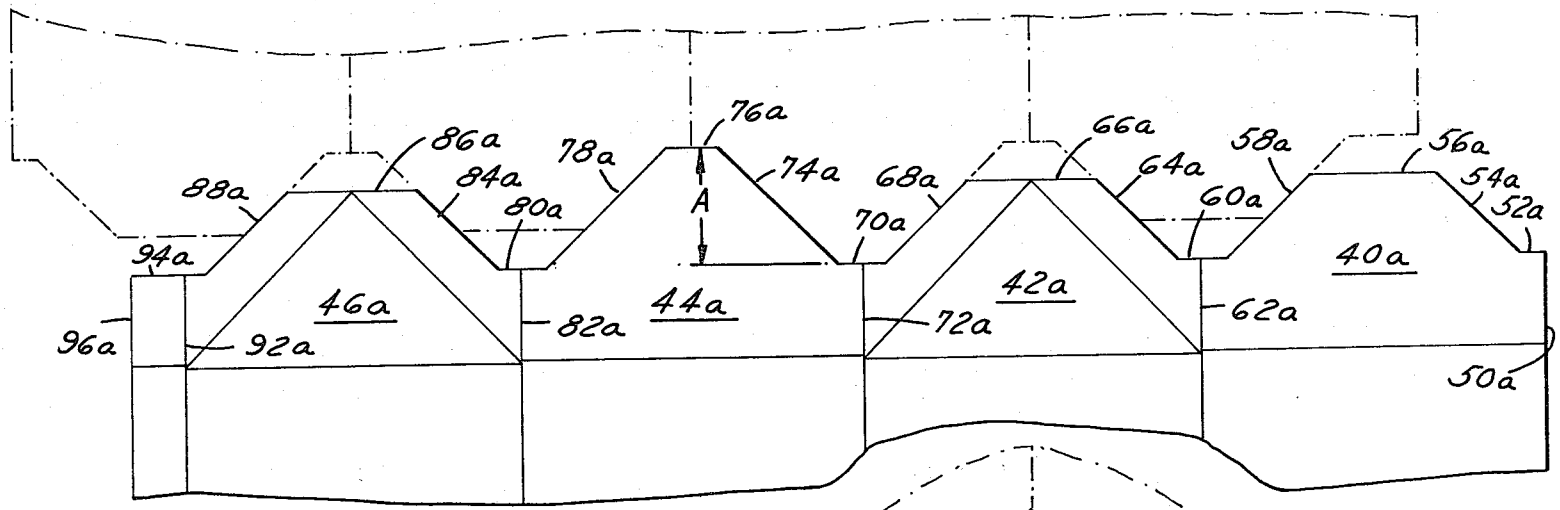
FIG. 6 is a layout view of a portion of an alternate blank embodiment of the invention.

In the alternate embodiment shown in FIG. 6, it may be noted that the longer corner score lines 50*a*, 62*a*, 72*a*, 82*a* and 92*a* are retained for the purpose described above relative to FIGS. 1-4, and that all are the same height. Full nesting of adjacent panels is accomplished only with respect to the adjacent longest panels 44*a*, the other three edges 56*a*, 66*a* and 86*a* nesting along the respective adjacent sloped score lines, but not reaching the bottom of the cutouts at 94*a*, [illegible] and 60*a*, respectively, hence, resulting in some scrap therebetween. Such scrap does not create a problem in that it is automatically drawn away by conventional pin stripping and/or suction stripping equipment in the converting operation.

INDUSTRIAL APPLICABILITY

It should be apparent, generally, that the overall carton bottom configuration has been changed to achieve better economies in the production of the carton blank, while the final carton construction has inside surfaces identical to those of the popular prior art carton shown and described in the above referenced Egleston et al U.S. Pat. No. 3,120,335.

It should be further apparent that one embodiment of the invention provides a bottom end closure for a liquid carrying paperboard container which is efficient to produce insofar as the forming of the blanks from a paperboard roll is concerned, in that a single knife cut produces side-by-side blanks without any scrap therebetween.

It should also be apparent that the invention provides a sturdy support at each corner for assisting in the folding and tucking operation when the blank is formed into a liquid carrying carton bottom closure.

While but three embodiments of the invention have been shown and described, other modifications thereof are possible.

The embodiments of the invention in which an exclusive property or privilege is claimed are defined as follows:

1. A blank for a container of foldable sheet material having an overall surface of thermoplastic material that becomes adhesive when subjected to heat, said blank comprising a plurality of side panels, first and second pairs of (opposed) bottom closure panels alternately connected to said side panels along a lateral score line as extensions thereof and connected one to the other by vertical score lines along their sides for a (predetermined) partial portion of their heights, each bottom closure panel having free cut edges extending in first directions parallel to said lateral score line and inwardly toward each other from the end of each vertical score line (for a thence in second angularly coverging directions and thence in third directions parallel to said first direction toward the centerline of said bottom closure panel and meeting at said centerline (such that the panels of the adjacent blank are interested therewith prior to being cut apart therefrom), said free cut edges extending in said first direction being such that they provide for an increased height of said vertical score lines and, hence, support for the container corners to be formed by said vertical score lines.

2. A blank for a container of foldable sheet material having an overall surface of thermoplastic material that becomes adhesive when subjected to heat, said blank comprising four substantially equal width side panels, first and second pairs of bottom closure panels alternately connected to said four side panels as extensions thereof and at least two of said bottom closure panels connected one to the other by score lines along their sides for a partial portion of their heights, adjacent bottom closure panels having a first free cut edge extending laterally in both directions from the end of the intermediate score line, a second free cut edge extending at an angle from the end of each of said first free cut edges toward the centerlines of said adjacent bottom closure panels, and a third free cut edge extending laterally from each second free cut edge to said centerlines, the height of said third free cut edge of at last two bottom closure panels being approximately equal to one half the width of a side panel, and the height of said third free cut edge of at least one bottom closure panel being greater than one half the width of side panel.

3. The blank described in claim 2, wherein two diagonal score lines are formed on each of two oppositely disposed closure panels extending from the junctures of respective closure panels and side panels to said laterally extending free cut edge at the centerline thereof, forming at least five-sided panels with respective side score lines and respective lateral and angled free cut edges.

4. The blank described in claim 2, wherein said angle is on the order of 45°.

5. A container of paperboard or the like having an overall surface of thermoplastic material that becomes adhesive when subjected to heat, said container comprising four substantially equal width side panels, first and second pairs of (opposed) oppositely disposed bottom closure panels alternately connected by a fold line to said side panels as extensions thereof and connected one to the other by score lines along their sides for a (predetermined) partial portion of their heights, each bottom closure panel having free cut edges symetrical with the center line thereof and extending (first) in a (predetermined configuration for a predetermined distance) first direction parallel to its fold line and from the (end) ends of said score lines for providing support at the corners formed by the vertical score lines, and thence (at) in a second (predetermined angle) direction angularly towards its; centerline and terminating at a point such that the heights of two oppositely disposed bottom closure panels are each equal to approximately one half the width of a side panel, and the height of at least one other bottom closure panel is (a predetermined amount) greater than one half the width of a side panel, said first pair of oppositely disposed bottom closure panels including diagonal score lines for forming triangular panels whose apices virtually touch one another on the inside of the container, and the end portion of said one other bottom closure panel overlapping the end portion of the fourth bottom closure panel on the outside of the container.

6. The container described in claim 5, wherein the terminal edge of said fourth bottom closure panel is sealed directly beneath along the center lines of said adjacent apices of said triangular panels, as viewed from the inside of the container, thereby substantially eliminating raw edges from being exposed on the inside of the container.

* * * * *

UNITED STATES PATENT OFFICE

CERTIFICATE OF CORRECTION

Patent No. 4,341,340 Dated July 27, 1982

Inventor(s) Robert E. Lisiecki

It is certified that error appears in the above-identified patent and that said Letters Patent are hereby corrected as shown below:

Column 5, line 45, delete "(opposed)".
" ", lines 48 to 49, delete "(predeter-mined)".
" ", line 53, delete "(for a".
" ", lines 56-58, delete "(such that the panels of the adjacent blank are internested therewith prior to being cut apart therefrom)".

Column 6, line 33, delete "(opposed)".
" ", line 37, delete "(predetermined)".
" ", line 39, delete "(first)".
" ", line 40 and 41, delete "(predetermined configuration for a predetermined distance)".
" ", line 42, delete "(end)".
" ", line 44, delete "(at)".
" ", line 44, delete "(predetermined angle)".
" ", line 45, delete the semicolon.
" ", lines 49 and 50, delete "(a predetermined amount)".

Signed and Sealed this

Twenty-sixth Day of April 1983

[SEAL]

Attest:

GERALD J. MOSSINGHOFF

Attesting Officer

Commissioner of Patents and Trademarks